United States Patent [19]

Whetten et al.

[11] Patent Number: 4,500,785

[45] Date of Patent: Feb. 19, 1985

[54] RADIATION DETECTOR HAVING A MULTIPLICITY OF INDIVIDUAL DETECTING ELEMENTS

[75] Inventors: Nathan R. Whetten, Burnt Hills; John E. Kelley, Albany, both of N.Y.

[73] Assignee: The United States of America as represented by the United States Department of Energy, Washington, D.C.

[21] Appl. No.: 382,329

[22] Filed: May 26, 1982

[51] Int. Cl.[3] ..... H01J 47/06

[52] U.S. Cl. ..... 250/385; 250/394

[58] Field of Search ..... 250/385, 394, 374; 378/10, 174, 19, 58

[56] References Cited

U.S. PATENT DOCUMENTS 4,047,041 9/1977 Houston ..... 250/374
4,119,853 10/1978 Shelley et al. ..... 250/385
4,392,237 7/1983 Houston ..... 250/385
4,394,578 7/1983 Houston et al. ..... 250/385
4,411,011 10/1983 LeMay ..... 378/10

*Primary Examiner*—Alfred E. Smith
*Assistant Examiner*—Carolyn E. Fields
*Attorney, Agent, or Firm*—Geoffrey H. Krauss; James C. Davis, Jr.; Marvin Snyder

[57] ABSTRACT

A radiation detector has a plurality of detector collection element arrays immersed in a radiation-to-electron conversion medium. Each array contains a multiplicity of coplanar detector elements radially disposed with respect to one of a plurality of positions which at least one radiation source can assume. Each detector collector array is utilized only when a source is operative at the associated source position, negating the necessity for a multi-element detector to be moved with respect to an object to be examined. A novel housing provides the required containment of a high-pressure gas conversion medium.

14 Claims, 12 Drawing Figures

Fig. 1
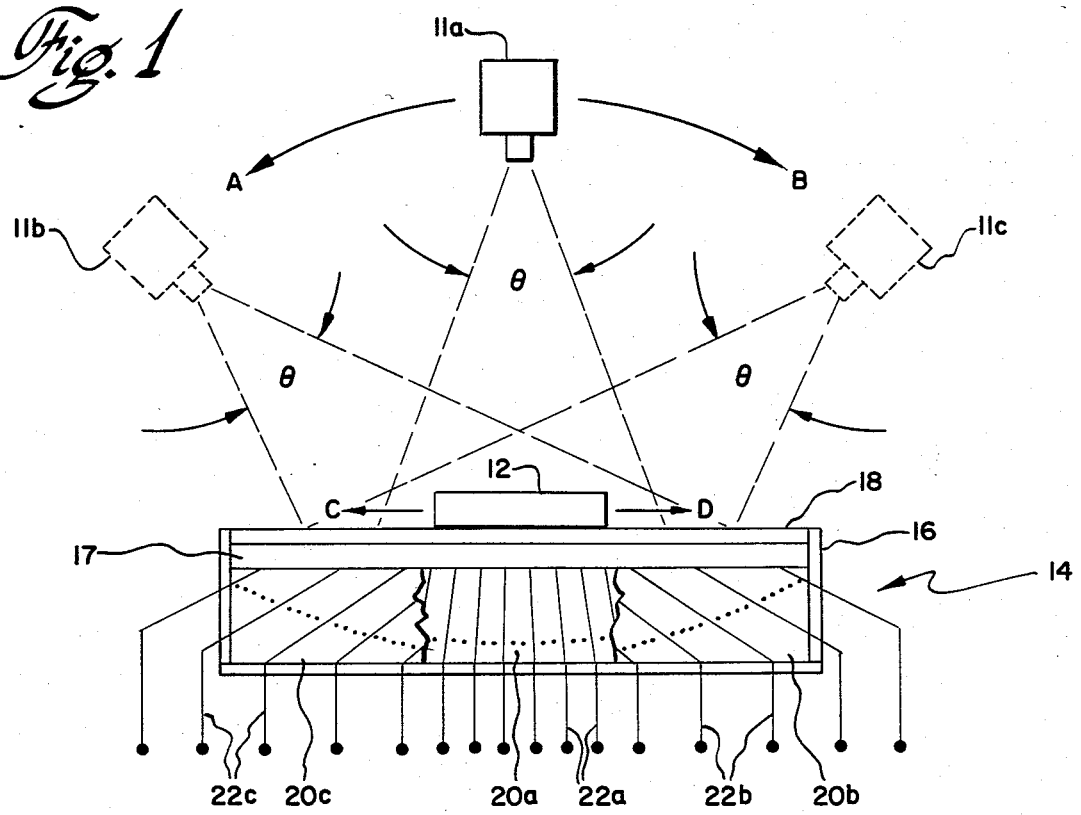
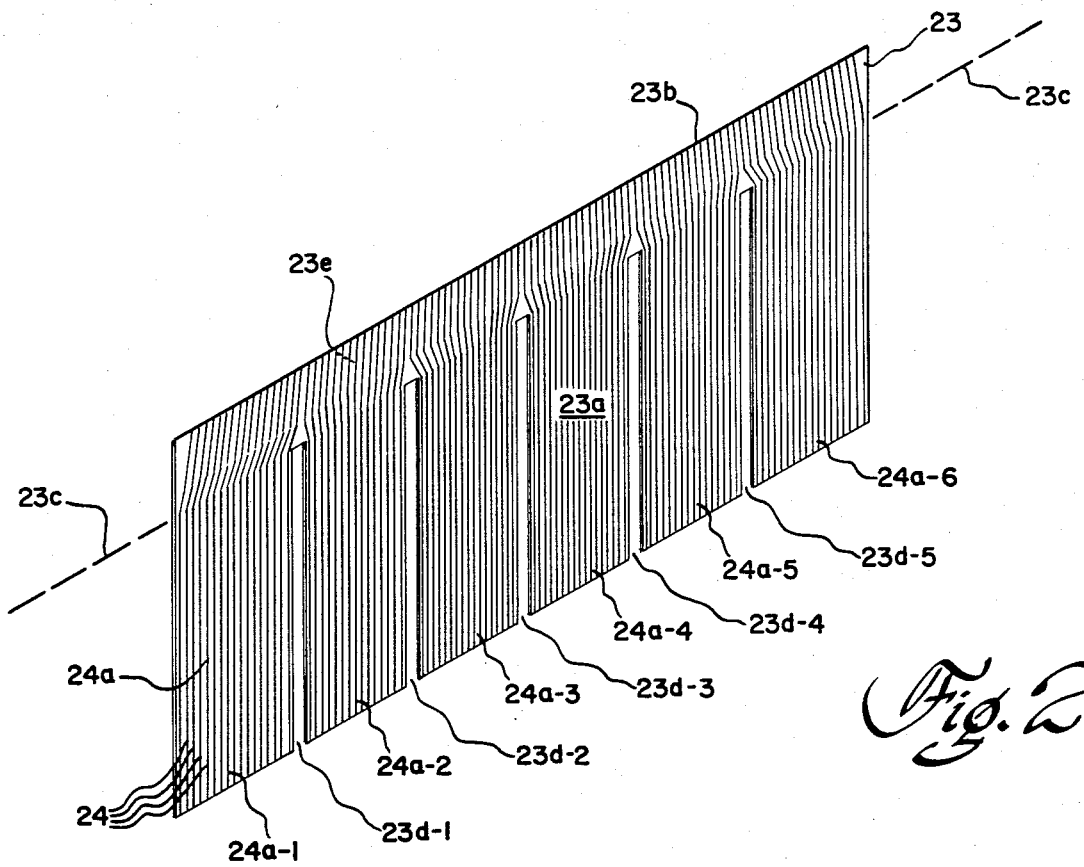
Fig. 2

16a-3
16a-2a
16a-2
16a-3
16a
26b
26a
26
30
16a-1
30

16b-3
40
44
16b
32
64
16b-4
32

44
36
38
38
36
56a
16b-3
32
16b
56
56b
32
64
16b-4

16a-4
16a-2a
16a-2
4a
4a
16a-1
16b-1
32
44
32
16b-2
4d
36
32'
4c
40
16b-3
32
36
32'
4d
68
4b
40
44
32
32
56a
4c
65
16a-4
32
16b-1
32
36
32
64
16b-1
32'
38
4b
65
64
56b
32
40
32
64
65
32
32
64
65
44
32
32'
64
65
32
32
16c-2
16b-2
64
4f
66
32
65
32
32
16b-4
32
4e
4f 32
66
66
4e
16c-1
32
32
32
32
32
32
38
38
34'
36
36
36
34'
32'
32'

67
67
64
16c-1
16c-1
32
66

16c
32
32
16c
32
16c-2
16c-1

16c-1
16c-1

RADIATION DETECTOR HAVING A MULTIPLICITY OF INDIVIDUAL DETECTING ELEMENTS

BACKGROUND OF THE INVENTION

The present application relates to radiation detectors and, more particularly, to a novel radiation detector having a multiplicity of individual detecting elements.

It is well known to use electromagnetic radiation, e.g. x-rays and the like, to examine an object. Typically, an x-ray examination system may utilize a single radiation source moved between each of a plurality of positions with respect to the object to be examined, with an array of radiation detectors fixedly positioned with respect to the source and moving about the object position in conjunction with source motion. It is highly desirable to have the system detection array remain stationary with respect to the object examination position, whereby the electrical leads from the detector elements need not be continually moved and flexed as the object is examined. It is also highly desirable to provide a detection system having a large multiplicity of individual detection elements, to increase the inspection system resolution. Hitherto, the reliability of a large detector has been reduced due to the possibility of breakage in the large number of associated flexible element lead wires. Thus, a radiation detector having an array of a multiplicity, typically on the order of several thousand, individual detecting elements and capable of providing high resolution detection of a source at various angular dispositions with respect to the detector, without movement of the detector, is highly desirable.

BRIEF SUMMARY OF THE INVENTION

In accordance with the invention, a radiation detector has a chamber in which a number N of arrays, each of a multiplicity of coplanar individual detector collection elements, are arranged in parallel fashion. Each of the arrays has the multiplicity of elements thereof radially disposed with respect to an associated one of a plurality of locations to which a radiation source can be moved, while the radiation detector remains at a fixed position with respect to an object to be examined. The detector element arrays are formed of etched conductive material on a thin, flexible insulative substrate, having lead portions designed to extend through one surface of an enclosing housing.

In one presently preferred embodiment, the detection medium is a gas, such as xenon and the like, under high pressure in a housing cavity containing the detector arrays. The element leads are formed into groups, whereby short slots are formed through the housing at one side of the cavity, to provide a very stiff housing portion resisting the detection medium pressure. A three-part housing, having a stiffening member, is utilized.

Accordingly, it is an object of the present invention to provide a novel radiation detector having increased resolution due to a large number of individual detecting elements.

This and other objects of the present invention will become apparent upon consideration of the following detailed description, when read in conjunction with the drawings.

BRIEF DESCRIPTION OF THE DRAWINGS

FIG. 1 is a side view of a radiation flaw-detection system in which the detection apparatus of the present invention may be utilized;

FIG. 2 is a perspective view of one of the arrays of a multiplicity of detector elements;

DETAILED DESCRIPTION OF A PREFERRED EMBODIMENT

Figure 3:
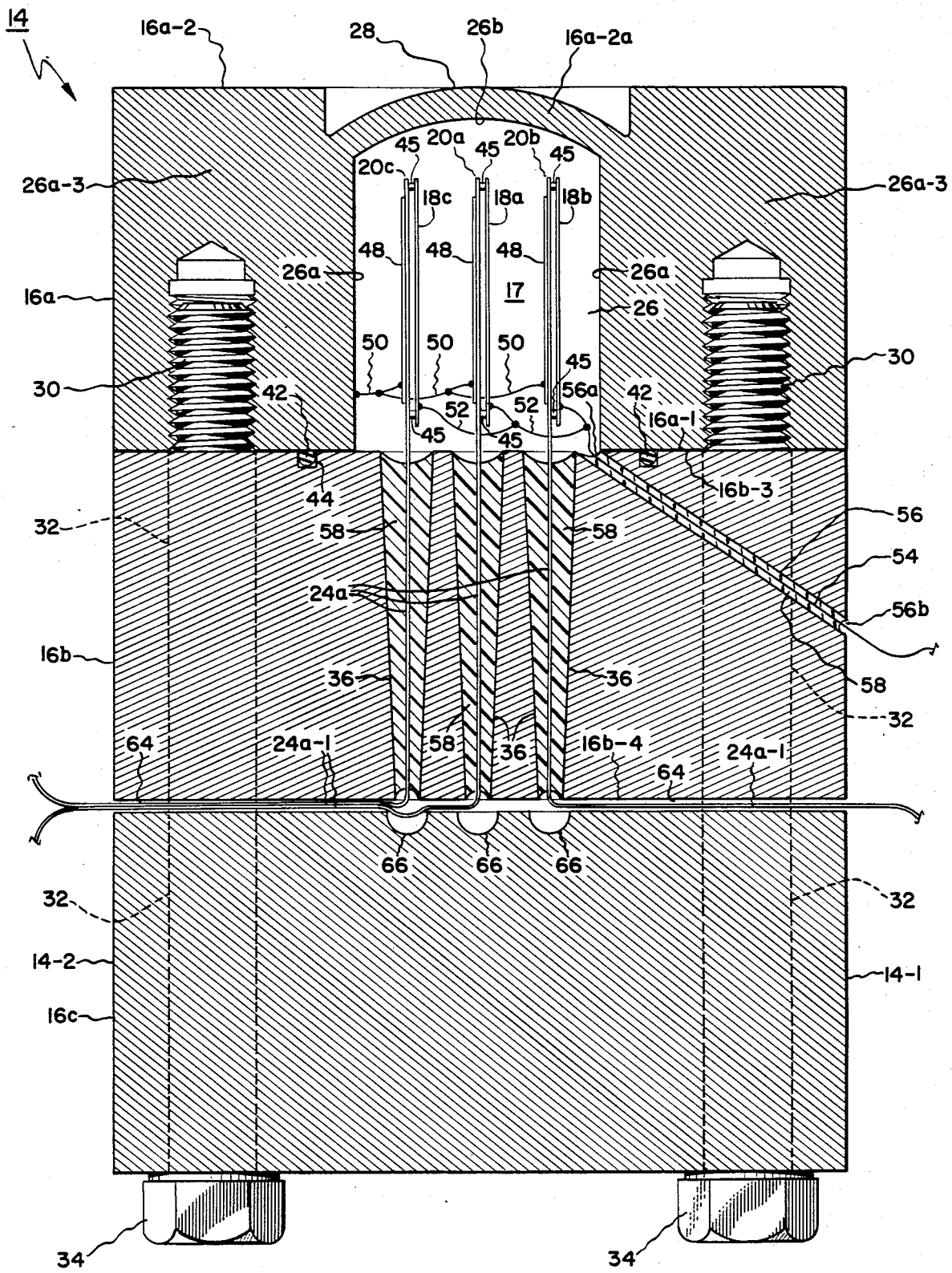
FIG. 3 is a section view of a detector in accordance with the principles of the present invention.

Referring intially to FIG. 1, a radiation detection system 10 utilizes a radiation source 11, such as a source of x-rays and the like, which can be pivotally moved, in the direction of arrows A and B, to various positions with respect to an object 12 to be inspected. A radiation detector 14 is positioned upon the opposite side of object 12 from source 11, and receives the radiation differentially absorbed by object 12 for analysis thereof. Illustratively, source 11 can be positioned at one of three locations; at a first location, source 11*a* is substantially perpendicular to the plane of object 12; at a second location, source 11*b* has been moved in the direction of arrow A, by a predetermined rotation about a fixed center position to obliquely illuminate object 12 from a first side direction; and at a third location, source 11*c* has been moved in the direction of arrow B, in the opposite direction from source 11*b* and by substantially a like degree of rotation, to obliquely illuminate object 12 from another side, opposite to the side at which source 11*b* illuminates the object. The radiation emitted from the source forms a fan beam of angle $\theta$, illustratively on the order of 40°. Object 12 can be moved, in step-wise or other fashion, in at least one of directions C and D, through the zone between source 11 and radiation detector 14. Each portion of object 12 is thus scanned three times, with the source respectively at zero, a first angle (e.g. 45°) left orientation and the same first angle (e.g. 45°) right orientation to the plane normal to the object surface.

The differentially-attenuated radiation is detected by apparatus 14. Apparatus 14 includes a pressure-tight housing 16 containing a detecting medium 17, such as xenon gas under high pressure and the like, in an electric field; a high voltage plate 18 is so positioned within detector assembly 14 as to provide a required field through the conversion medium, to move electrons or ions (resulting from radiation quanta collisions with molecules of the medium) to the applicable one of a plurality of detector element arrays 20. The number N of detector element arrays 20 is equal to the number N of positions, e.g. N=3, that radiation source 11 assumes during scanning of each location of object 12. One of detector element arrays 20 is assigned to each source location, and contains a multiplicity, typically between 20 and 10,000, of linear detector elements arrayed in the plane of source 11 rotation and radially disposed with respect to the source 11 location associated therewith. Thus, a first detector element array 20*a* is associated with source 11*a* at the perpendicular location; the elongated linear detector elements 22*a* thereof are coplanar positioned so as to converge toward the source 11*a* location. A second linear detector array 20*b* has a like multiplicity of coplanar, elongated linear detector elements 22*b*, so positioned as to converge toward the location of source 11*b* associated therewith. The third detector element array 20*c* also has a like multiplicity of coplanar, elongated linear detector elements 22*c* positioned to converge toward the position of the associated radiation source 11*c*location. Each linear conductor element 22 of the detector element arrays 20*a*, 20*b* and 20*c* is individually available for connection to processing electronics (not shown). The electrical connection of the element of a particular array to the processing electronics is facilitated, by known means, dependent upon the source being at the source position associated with that particular array. The conversion of radiation quanta to an electronic signal in the high pressure xenon gas, and collection of the resulting electrons by the closest detector element 22, under influence of an electric field provided by high voltage plate 18, is itself known to the art.

Referring now to FIG. 2, each of the detector arrays, e.g. detector array 20*a*, utilizes a flexible substrate 23, formed of polyimide and the like materials. One surface 23*a* of the substrate has a conductive layer, as of copper and the like material, fabricated, as by photolithography and the like technique, into the array of detector collector elements 22, each having an integrally joined associated lead 24. A high-conductive coating, of gold and the like, may be used over each of the elements 22. Advantageously, each detector collector element 22 is a 2-milli-inch wide conductive line, with a 1-milli-inch average spacing between lines. Because detector collector elements 22 converge toward the substrate top edge 23*b*, the spacing increases as the lines progress from top edge 23*b* toward an imaginary line 23*c*, parallel to but spaced from edge 23*b*. The collector elements 22 are positioned with increasing symmetrical angulation about that detector line 22′ at the center of array 20*a*. However, because the detector arrays 20*b* and 20*c* are associated with the source being positioned at an angle with respect to the plane normal to the frontal plane of the detector, all of the collector elements 22*b* and 22*c* of these arrays will be at some angle to the forward substrate edge 23*b* of the associated array substrate.

Each of the array substrates includes a plurality of slots 23*d*, e.g. five slots 23*d*-1 through 23*d*-5 illustrated, for a purpose which will beome apparent hereinbelow. The associated collector element leads 24 are so positioned as to pass around slots 23*d*, requiring that these connecting lines become somewhat narrower in areas defined at the end of slots 23*d* adjacent to line 23*c*.

Figures 4, 4A, 4B, 4C, 4D, 4E, 4F:
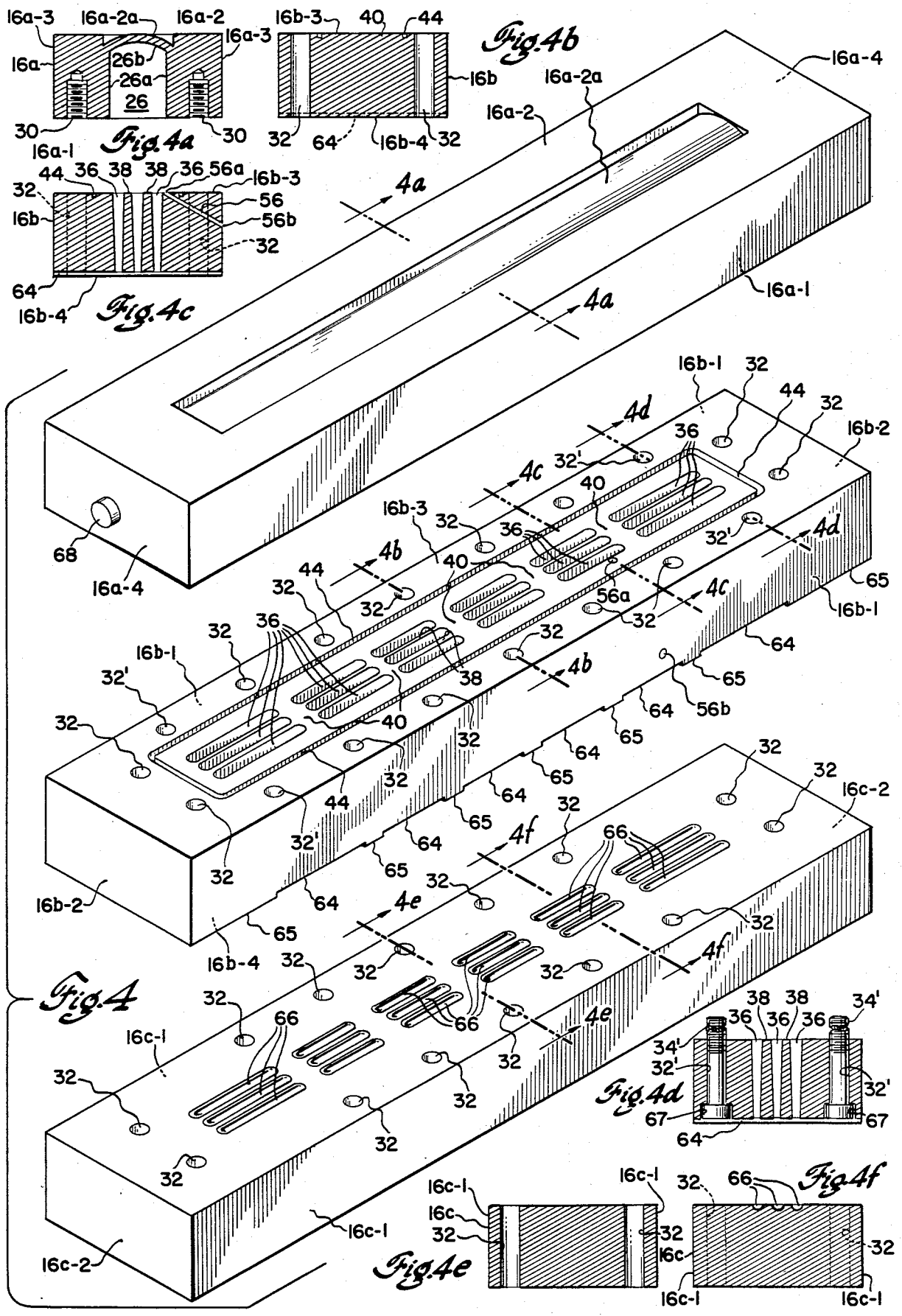
FIG. 4 is an exploded perspective view of a detector housing.
FIG. 4*a* is a sectional view of the top detector housing member, taken along lines 4*a*—4*a* of FIG. 4.
FIGS. 4*b*, 4*c* and 4*d* are sectional views of the middle detector housing member, taken along lines 4*b*—4*b*, 4*c*—4*c* and 4*d*—4*d*, respectively, of FIG. 4.
FIGS. 4*e* and 4*f* are sectional views of the lower detector housing member, taken along lines 4*e*—4*e* and 4*f*—4*f*, respectively of FIG. 4.
Figure 5:
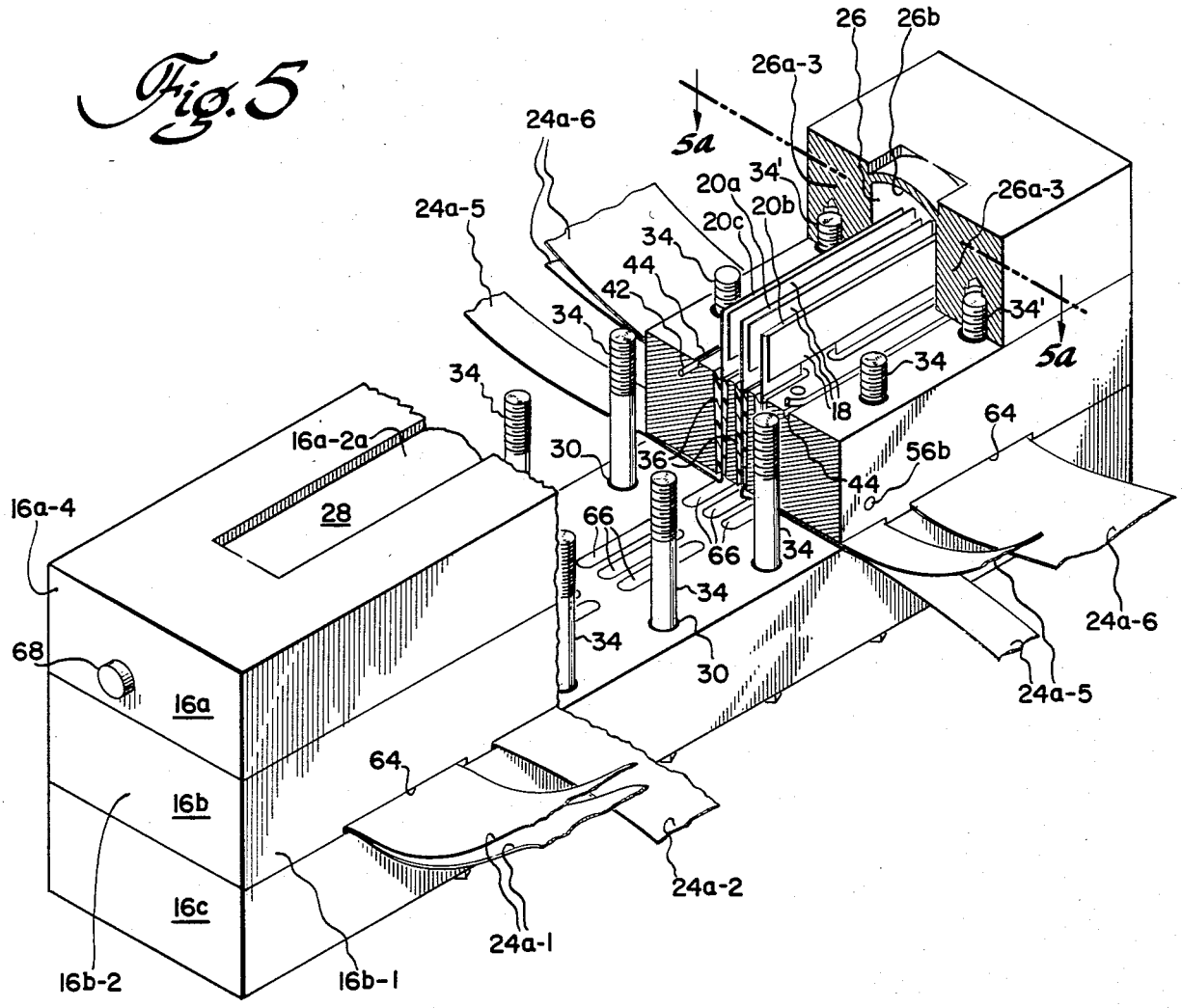
FIG. 5 is a partially sectioned perspective view of a completed detector assembly.

Referring now to all of the Figures, the high pressure gas 17 and the plurality of detector collector element arrays 20, each with an associated high voltage plate 18, are enclosed in housing 16 (FIGS. 3, 4 and 5). The housing comprises a top or front housing member 16*a*, a middle housing member 16*b* and a bottom or rear housing member 16*c*. Front housing member 16*a* has a substantially rectangular cavity 26 formed therein through a bottom surface 16*a*-1; the cavity has substantially planar and substantially parallel side and end walls 26*a* and 26*c*, respectively, and a concave bottom 26*b*. The front surface 16*a*-2 of top member 16*a* has a portion 28 thereof fabricated with convex curvature, whereby a rectangular elongated portion 16*a*-2*a* of the top member is of substantially constant thickness and forms a radiation "window". Window portion 16*a*-2*a* is bowed outwardly to facilitate containment of the high pressure radiation-conversion medium, typically xenon gas, contained within detector 14 at a pressure on the order of 80 atmospheres. The relatively thick side and end portions 26*a*-3 and 26*a*-4, respectively, of member 16*a* have threaded apertures 30 tapped partially therethrough (FIGS. 3 and 4*a*) from bottom surface 16*a*-1.

Middle housing member 16*b* and lower housing member 16*c* are of the same substantially rectangular shape as top housing member 16*a*. Each of members 16*b* and 16*c* has a plurality of apertures 32 in the relatively thick side wall and end wall portions 16*b*-1, 16*b*-2, 16*c*-1 and 16*c*-2 thereof, of number and position located for passage of fastening means 34, such as a bolt and the like, therethrough and into tapped holes 30.

The elongated detector collector element arrays 20 extend along the length of the cavity 26 fabricated into top member 16*a*. The lead portion 24*a* of each flexible detector assembly board must be brought out of the high-pressure detector cavity 26 through member surface 16*a*-1 and middle member 16*b*. However, because of the magnitude of pressure contained within cavity 26, the least disruption of middle member 16*b*, by passage of lead portions 24*a*, is desired. A series of coplanar, separated thin slots 36 are fabricated through the thickness of middle housing member 16*b*, from the forward surface 16*b*-3 to the rear surface 16*b*-4 thereof (FIG. 4). A plurality of remaining longitudinal strips 38, in between the plane of each of the plurality of detector arrays, and a plurality of remaining cross-wise portions 40 thus form a stiffening web enhancing the resistance of the housing to the high-pressure gas contained within cavity 26; bottom member 16*c* further stiffens middle member 16*b*. A pressure gasket 42 is provided in a channel 44 fabricated into the upper surface 16*b*-3 of middle housing member 16*b*, about the area in which the plurality of elonged apertures 36 is contained. Groove 44, and sealing means 42 contained therein (FIG.-3), is so positioned as to be outward of the periphery of cavity 26, whereby seal means 42 can be compressed by the rear surface 16*a*-1 of the front housing member 16*a*. The lead portion 24*a* of each of the collector element arrays 20 pass through an associated line of slots 36, with array slots 23*d* being positioned to provide clearance at the location of web cross members 40. Advantageously, as shown in FIG. 3, slots 36 have a tapering cross section, being somewhat narrower at middle housing member rear surface 16*b*-4 than at middle housing member front surface 16*b*-3.

Figure 5A:
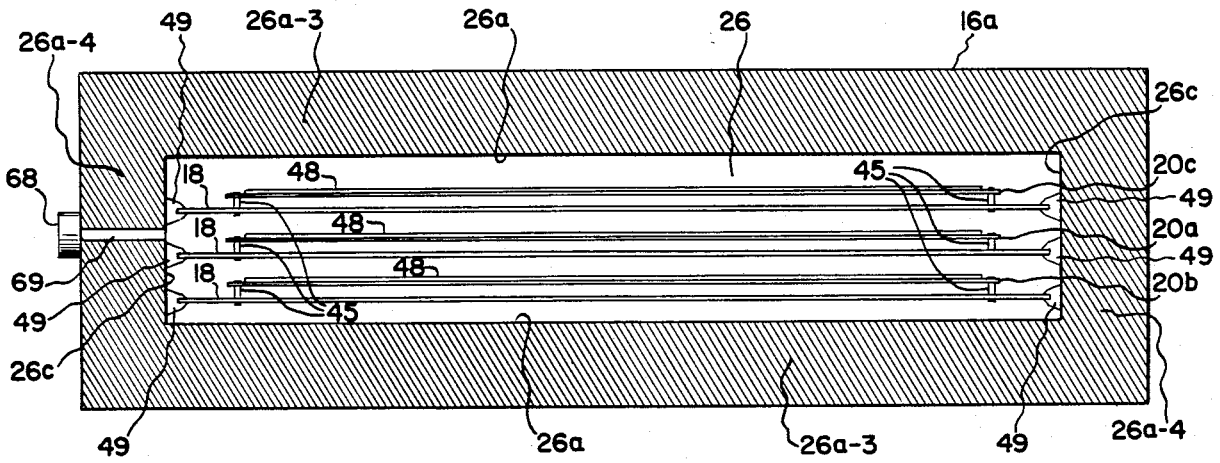
FIG. 5*a* is a sectional top view of the detector assembly, taken along lines 5*a*—5*a* of FIG. 5.

In a presently preferred embodiment, in which three detector arrays 20*a*–20*c* are utilized, a separate high voltage plate 18*a*–18*c* is associated with each array 20 (FIG. 3). The high voltage plate is attached to the flexible array substrate by suitable insulating means 45, such as nylon bolts, nuts and other hardware (FIG. 5*a*). A portion of the array substrate rear surface 23*e* (FIG. 2) has a conductive strip 48 fabricated thereon, of graphite and the like material, opposite only that portion of the substrate having detector collector lines 22, i.e. from top edge 23*b* to imaginary line 23*c*. The conductive strips are maintained at ground potential, to establish the detector electric field in conjunction with the associated one of voltage plates 18.

Each collector subassembly (of the relatively rigid voltage plate 18, insulatively fastened to and spaced from the detector-element-bearing surface 23*a* of a detector substrate 23, having a conductive strip 48 upon the opposite surface 23*e* thereof) is positioned within cavity 26 (FIG. 5*a*). The voltage plates 18 are fabricated of a length slightly less than the length of cavity 26; the voltage plate ends are fastened to the cavity end walls 26*c* by suitable insulative fastening means 49, such as deposits of insulative epoxy and the like, with the detector array 20 planes substantially parallel to one another and to cavity side walls 26*a*. The conductive backing members 48 are connected together and to the conductive cavity wall by leads 50 (FIG. 3). The voltage plates 18 of the plurality of detector subassemblies are connected together by leads 52; a voltage input lead 54 is extended from a plate, e.g. 18*b*, closest to one of cavity side walls 26*a*. Middle housing member 16*b* includes an aperture 56 (FIGS. 3 and 4*c*) having an upper entrance point 56*a* at upper surface 16*b*-3 which will be within cavity 26, and an exit point 56*b* at the side of middle housing member 16*b*. High voltage lead 54 is carried through middle housing member side wall 16*b*-1 in aperture 56, while the detector array lead portions 24*a* are carried through middle housing member slots 36. Once the high voltage lead 54 has been positioned in aperture 56 and lead portions 24 have been positioned in slots 36, an insulative material 58, such as an epoxy and the like, is forced into slots 36 and aperture 54 to backfill the openings through middle member 16*b* and provide a pressure-tight seal thereat.

The middle housing member bottom surface 16*b*-4 is provided with a set of relief portions 64, aligned with slots 36 and extending at right angles thereto, and leaving buttress portions 65 therebetween. Lower housing member 16*c* is provided with a set of grooves 66 in registration with an edge of relief portions 64 and slots 36, whereby the remaining array lead portions 24*a*-1 through 24*a*-6 can be bent and brought out through the sides of housing assembly 14, when lower housing member 16*c* is fastened to middle housing member 16*b*. Because lead portions 24*a* cannot be bent at an abrupt right angle, grooves 66 are provided to allow a sufficient bending radius to be utilized. Remaining lead portions 24*a*-1 through 24*a*-6 thus emerge from the side surfaces 14-1 and 14-2 of the detector assembly (FIG. 5). The forward surface of bottom member 16*c* abuts against the buttress portions of member 16*b* to provide additional mechanical strength thereto.

After assembling the detector collector arrays into cavity 26 and sealing array lead portions 24*a* and lead 54 in slots 36 and aperture 56, respectively, the middle member 16*b* is fastened against top member 16*a* by fastening means 34' passing through those apertures 32' located in recesses 64. Recessed clearance portions 67 allow the fasteners to be recessed to clear array lead portions 24*a*-1 and 24*a*-6, when the lead portions are bent over into recesses 64. The bottom member is now fastened to the remainder of the housing with the remainder of fastening means 34 (those passing through apertures 32 in the middle member buttress portions 65). A suitable pressurizing-media inlet means 68 is fabricated to one wall, e.g. end wall 16*a*-4, of the top housing member and operates to seal a medium-inlet aperture 69 formed through the wall of the member. After utilizing means 68 to introduce a pressurized testing medium through aperture 69, the pressure-tested assembly is evacuated and the xenon detection gas introduced to a pressure of about 1200 psi (80 atmospheres). Means 68 is thereafter operated to seal aperture 69 and retain the detection medium under pressure within the housing.

It will be seen that deflection of the detector housing 16 is greatly reduced by means of the stiffening action of lower housing member 16*c* and by the relatively short lengths of slots 36 in conjunction with the supporting web of portions 38 and 40 formed thereby.

While one presently preferred embodiment of our novel radiation detector is described herein, many modifications and variations will now become apparent to those skilled in the art. It is our intent, therefore, to be limited only by the scope of the appending claims and not by the particular details and instrumentalities presented by way of illustrative example herein.

What is claimed is:

1. A radiation detector fixedly positioned relative to the location at which an object to be examined is to be located, and used with a radiation source movable to each sequential one of a plurality N of different positions relative to the fixedly-positioned radiation detector, said detector converting differentially-absorbed radiation from said movable source to electrical signals, comprising:

a housing having a cavity;

a medium contained within said cavity for conversion of radiation quanta to charged particles;

means within said cavity for establishing a plurality N of electric fields; and a plurality N of different linear detector arrays each located in a plane parallel to and spaced from the plane of all other arrays and each having a multiplicity of elongated detector elements, each detector element in a particular one of said arrays being disposed substantially coplanar with all other detector elements of that array and with the elongated direction thereof substantially directed at the associated one of said plurality N of locations of said source, each detector element cooperating with only one associated different one of said plurality of field-establishing means for collection of charged particles formed in an associated portion of said cavity to provide an associated one of said electrical signals.

2. The detector of claim 1, wherein each of said arrays has between about 20 and about 10,000 detector elements.

3. The detector of claim 2, wherein each array includes a like multiplicity of conductive lead means, each connected to an associated detector element; and said housing includes passage means for allowing said lead means to extend from said cavity to the exterior of said housing.

4. The detector of claim 3, wherein said passage means includes a series of elongated apertures in said housing so positioned as to allow passage of said lead means therethrough; and means, filling the remaining volume of said apertures not occupied by said lead means, for forming a pressure-tight seal at said apertures.

5. The detector of claim 4, wherein said conversion medium is a gas under pressure within said cavity.

6. The detector of claim 2, wherein each of said plurality N of field-establishing means includes: means receiving a field-forming potential; and a conductive member spaced from and substantially parallel to the associated array and connected to said potential-receiving means.

7. The detector of claim 6, wherein each of said plurality N of field-establishing means further comprises: an additional conductive member maintained substantially at ground potential and insulatively spaced from and substantially parallel to the associated array upon the opposite side of the plane of that array from that side of the array facing the associated conductive member receiving said field-forming potential.

8. The detector of claim 7, wherein each of said plurality N of arrays further includes an insulative flexible substrate having a first surface upon which the plurality of conductive detector elements is fabricated, and a second surface upon which said additional conductive member is fabricated juxtaposed to said array of detector elements.

9. The detector of claim 8, wherein each array includes a like multiplicity of conductive lead means, each integrally connected to an associated detector element, with each array substrate supporting said integral detector element and lead means; and said housing includes at least a plurality N of passage means each for allowing at least a portion of the separate set of said lead means, with each set including a plurality of the lead means associated with only one of said arrays, to exit from said cavity to the exterior of said housing.

10. The detector of claim 9, wherein said passage means includes a series of elongated apertures in said housing each so positioned as to allow passage of one set of said lead means therethrough, and a plurality of said passage means apertures are linearly arranged for each array with a web portion of said housing disposed between adjacent apertures; and said substrate includes a plurality of slots arranged to pass the housing web portions therebetween.

11. The detector of claim 1, wherein said housing comprises: a first member having first and second opposed surfaces and a cavity-forming formation formed into said second surface; a second member having a substantially-flat first surface in abutment with said first member second surface and enclosing said cavity-forming formation to form said housing cavity; means for forming a pressure-tight seal between said first member second surface and said second member first surface; and means, having a third member abutting another surface of said second member, opposite to said second member first surface, for providing additional strength to said housing.

12. The detector of claim 11, wherein said first member cavity has a bottom surface, closest to said first member first surface, substantially concave with respect to said first member second surface and has a substantially convex portion in the first surface thereof, whereby the portion of the first member forming that cavity portion nearest to said first member first surface is curved and of substantially constant thickness.

13. The detector of claim 11, wherein said first member further includes means for filling and maintaining said housing cavity with said conversion medium under pressure.

14. The detector of claim 13, wherein said conversion medium is xenon gas at a pressure on the order of 80 atmospheres.

* * * * *